US005163820A

United States Patent [19]

Karliner

[11] Patent Number: 5,163,820

[45] Date of Patent: Nov. 17, 1992

[54] AIRLESS SPRAYER WITH ADJUSTABLE PRESSURE UNLOADING VALVE

[75] Inventor: Rudolf R. Karliner, Minnetonka, Minn.

[73] Assignee: Karldom Corporation, Waconia, Minn.

[21] Appl. No.: 733,359

[22] Filed: Jul. 19, 1991

Related U.S. Application Data

[63] Continuation of Ser. No. 520,130, May 7, 1990, abandoned, which is a continuation of Ser. No. 391,714, Aug. 7, 1989, abandoned, which is a continuation-in-part of Ser. No. 120,938, Nov. 16, 1987, abandoned.

[51] Int. Cl.[5] ..... F04B 43/06

[52] U.S. Cl. ..... 417/388; 92/169.2

[58] Field of Search ..... 417/383, 385, 386, 387, 417/388; 92/169, 169.2, 169.3, 169.4; 277/165, 177

[56] References Cited

U.S. PATENT DOCUMENTS

| | | | |
|---|---|---|---|
| 3,338,170 | 8/1967 | Swartz . | |
| 3,416,453 | 12/1968 | Feuillebois et al. . | |
| 3,433,161 | 3/1969 | Vetter . | |
| 3,671,150 | 6/1972 | Jackson et al. | 417/385 X |
| 3,680,981 | 8/1972 | Wagner . | |
| 3,779,384 | 12/1973 | Stahlkopf . | |
| 3,961,860 | 6/1976 | Ernst . | |
| 4,019,837 | 4/1977 | Eull | 417/388 X |
| 4,022,381 | 5/1977 | Karliner | 417/388 X |
| 4,184,809 | 1/1980 | Kelley . | |
| 4,353,684 | 10/1982 | Christman . | |
| 4,378,201 | 3/1983 | Quarve . | |
| 4,403,924 | 9/1983 | Gebauer et al. . | |
| 4,564,340 | 1/1986 | Stahlkopf . | |
| 4,619,589 | 10/1986 | Muller et al. . | |

*Primary Examiner*—Leonard E. Smith
*Attorney, Agent, or Firm*—Woodard, Emhardt, Naughton, Moriarty & McNett

[57] ABSTRACT

A pressure unloading valve responsive primarily to the pressure of the outlet passage in a diaphragm pump. The pump includes a driving fluid chamber and a pump chamber separated by a flexible diaphragm. Between the pump chamber and the outlet passage is a check valve allowing fluid flow only from the pump chamber to the outlet passage. The unloader valve is unseated, allowing relief of fluid pressure in the driving fluid chamber, when the pressure in the outlet passage exceeds a first predetermined value or when the pressure in the driving fluid chamber exceeds a second predetermined value. An adjustment knob is provided to vary the first and second predetermined values. An anti-blow-by seal is provided to check fluid seepage from the driving fluid chamber to the sump.

23 Claims, 2 Drawing Sheets

AIRLESS SPRAYER WITH ADJUSTABLE PRESSURE UNLOADING VALVE

FIELD OF THE INVENTION

This application is a continuation of application Ser. No. 520,130, filed May 7, 1990, now abandoned, which is continuation of application Ser. No. 391,714, filed Aug. 7, 1989, now abandoned, which is a continuation-in-part of application Ser. No. 120,938, filed Nov. 16, 1989 abandoned.

BACKGROUND OF THE INVENTION

Diaphragm pumps commonly used for airless sprayers have received a great deal of design attention to alleviate various problems of wear, breakdown and expense of manufacturing. Toward that end, several devices have been developed which provide hydraulic feedback governed by the outlet pressure of the pump and which govern the pressure of the driving fluid. For example, U.S. Pat. No. 4,353,684 discloses a double poppet relief valve, one for low outlet pressure and one for high outlet pressure. As the outlet pressure increases, the low pressure poppet relief valve is biased closed causing the secondary poppet relief valve to act as the primary relief valve, it being set to open at a higher pressure value. U.S. Pat. No. 3,779,384 shows an output regulated valve which operates by decreasing the inlet fluid flow to the driving fluid chamber. In U.S. Pat. No. 3,433,161, the overflow valve is controlled by the outlet pressure of the driven fluid. An increase in the outlet pressure further biases the valve head into its seat, thus increasing the relief valve pressure point for the driving fluid. U.S. Pat. No. 3,416,453 discloses an automatic pressure limiting device with a hydraulic servo motor which includes a differential piston having opposing pressure faces responsive to the outlet pressure. This device releases excess pressure from the driving side of the diaphragm when the outlet gas pressure drops below the hydraulic pressure on the driving side. None of the above patents properly addresses the problem resulting from a blockage or temporary cessation of outlet fluid flow with the pump motor continuing to work against the diaphragm. Continual input on the driving side of the diaphragm where there is no outlet for the driven fluid results in a continual, excessively high pressure pounding against the diaphragm and against the conventional check valves. The resulting increased wear of these parts will shorten their life and tends to cause malfunctions of the pump.

Conventional pumps with no feedback such as the one disclosed in U.S. Pat. No. 3,680,981 will permit bypass of driving fluid in a stand-by mode in response to a high preset driving fluid pressure which is also equal to the driven fluid pressure. Both the inlet and outlet valves of the driven fluid side are still operating in this stand-by mode. Though operating at a reduced level, these inlet and outlet valves are being needlessly subjected to increased wear as are other components such as the eccentric bearing and the valves on the driving fluid side. Further, if the pump is shut off without unloading the preset pressure, the pump will not restart unless all pressure is released either by opening the hydraulic pressure valves or unloading the paint prime valve.

Another consequence of the excess hydraulic pounding on the driving fluid side of the diaphragm is hydraulic fluid blow-by, or seepage out of the driving fluid pressure chamber back into the sump. The use of conventional o-rings, such as those shown generally in U.S. Pat. Nos. 4,184,809 and 3,961,860, may offer temporary protection. But, seals such as these, relying in part for their effectiveness upon compression between two adjacent and mechanically joined components, are prone to failure as the two components loosen relative to one another. A more reliable solution has been to manufacture these components following strict tolerance guidelines. Although this has significantly reduced the fluid blow-by problem, it has proven to be much more costly.

What is needed is a device responsive to excess pressures in the outlet fluid flow which will correspondingly cut off the high pressure hydraulic input to the diaphragm. Also needed is an inexpensive manner of preventing fluid blow-by from the driving side of the diaphragm.

SUMMARY OF THE INVENTION

Generally speaking, there is provided an adjustable pressure unloading valve which is responsive to changes in pressure of the pump fluid at the outlet of a diaphragm pump. According to one embodiment, a diaphragm pump has a driving fluid chamber and a pump chamber separated by a flexible diaphragm; inlet and outlet passages to the pump chamber; an outlet check valve separating the pump chamber from the outlet passage; and, drive means for alternately pressure loading and unloading pumping fluid in the driving fluid chamber. A needle valve providing relief to the driving fluid chamber pressure is provided the valve being responsive primarily to changes in pump fluid pressure in the outlet passage.

It is an object of the present invention to provide a valve device in a diaphragm pump which relieves the continual loading upon the flexible diaphragm when the outlet of the pump is blocked.

It is another object of the present invention to provide a device for a diaphragm pump which relieves the driving fluid pressure in response to changes in the pump fluid pressure.

It is a further object of the present invention to provide a valving device which both relieves high pressure surges of the driving fluid pressure and which relieves driving fluid pressure in response to blockages in the outlet line.

It is another object of the present invention to provide a device for a diaphragm pump which retards hydraulic fluid blow-by from the driving fluid chamber.

Related objects and advantages of the present invention will become apparent from the following description.

DESCRIPTION OF THE PREFERRED EMBODIMENT

Figure 1:
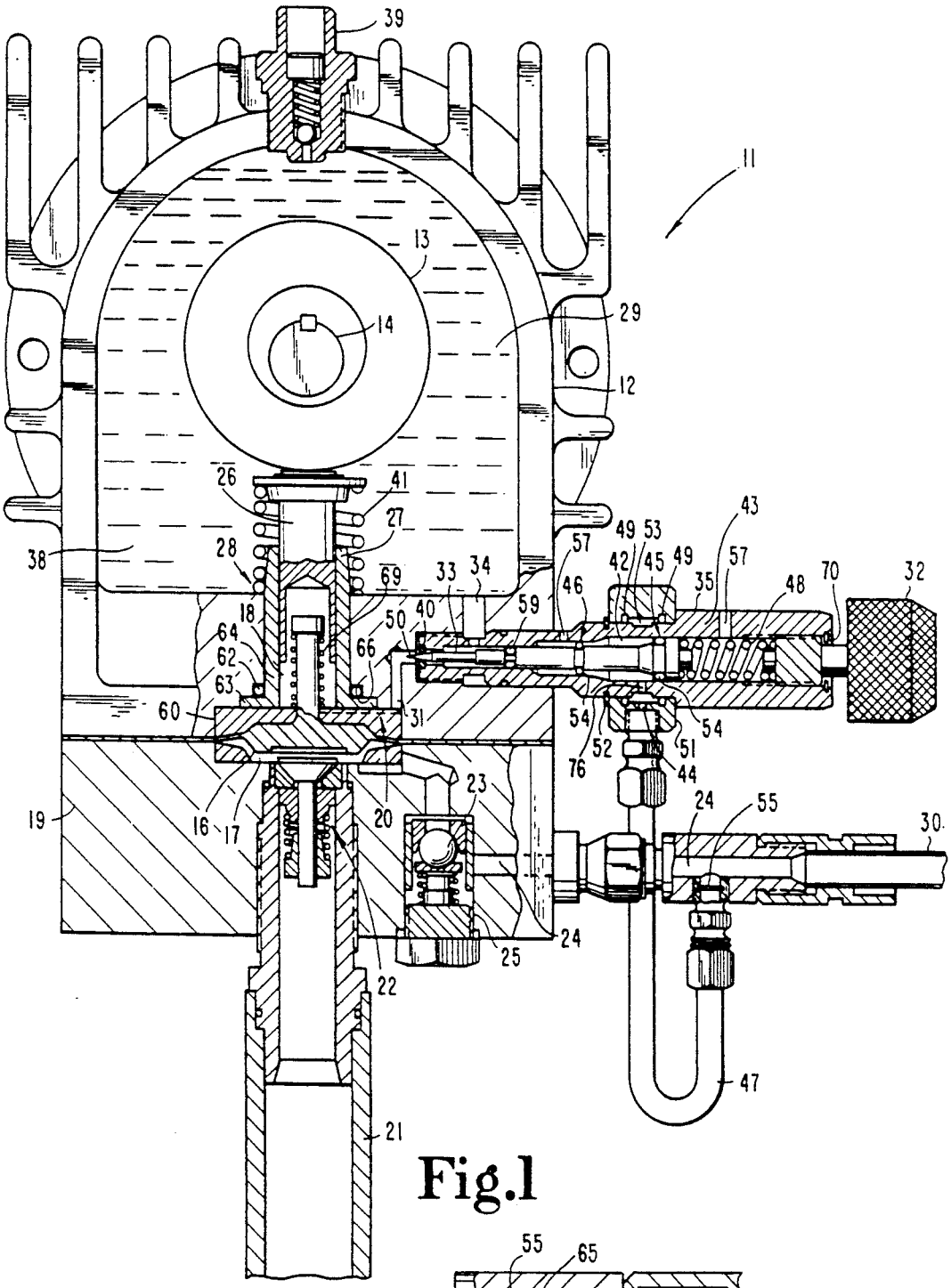
FIG. 1 is a diagrammatic front vertical cross-sectional view of a diaphragm pump according to one embodiment of the present invention.
Figure 3:
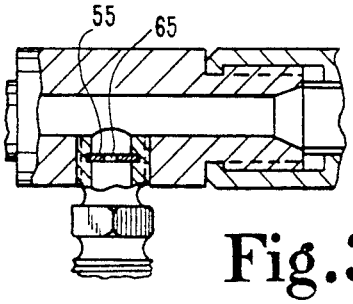
FIG. 3 is an enlargement of a portion of FIG. 1 showing diaphragm 55 and restricter hole 65.

Referring to FIG. 1 there is shown a diaphragm pump 11 according to one embodiment of the present invention. Pump 11 includes an aluminum casing 12 and an eccentric bearing 13 driven by shaft 14 and a motor (not shown). A pump chamber 17 is defined between a flexible plastic diaphragm 16 and pump body 19 which is rigidly attached to housing 12. A driving fluid chamber 18 for hydraulic fluid or the like is defined by diaphragm 16, steel cylindrical cylinder 27, steel piston 26 and upper retaining member 60.

Fluid to be sprayed such as paint is supplied from a container, positioned below pump 11, through inlet line 21. A primer valve 68 (FIG. 2) is provided from the outlet of check valve 25 to prime the paint flow and to allow return of fluid in inlet line 21 back to the paint container. A check valve 22 is provided in line 21 to permit flow of the fluid to be sprayed only into chamber 17. The pressurized paint is discharged through an outlet check valve 25, which includes a tungsten carbide check ball 23, and into outlet passage 24 and to a supply hose 30 which leads to a conventional spray gun (not shown). Conventional spray guns of the type commonly used with pumps similar to the pump described herein have a control valve which throttles or completely stops the outlet flow of pressurized fluid from outlet passage 24.

Diaphragm 16 is axially movable with driving pressure intermittently applied (compression) and relieved (suction) by means of hydraulic fluid in chamber 18. This driving pressure is provided by a piston pump generally identified as 28 and including a cylindrical chamber 27 slidably receiving a cylindrical piston 26 driven by eccentric drive bearing 13 rotated by a driving motor (not shown). Cylindrical piston 26 includes a spring retainer 72 held by a retaining ring 73. (FIG. 2) Spring retainer 72 holds spring 41 in compression between it and casing 12. Diaphragm 16 includes a retaining nut 75 which holds return spring 69 in compression between it and upper diaphragm retaining member 60.

Figure 2:
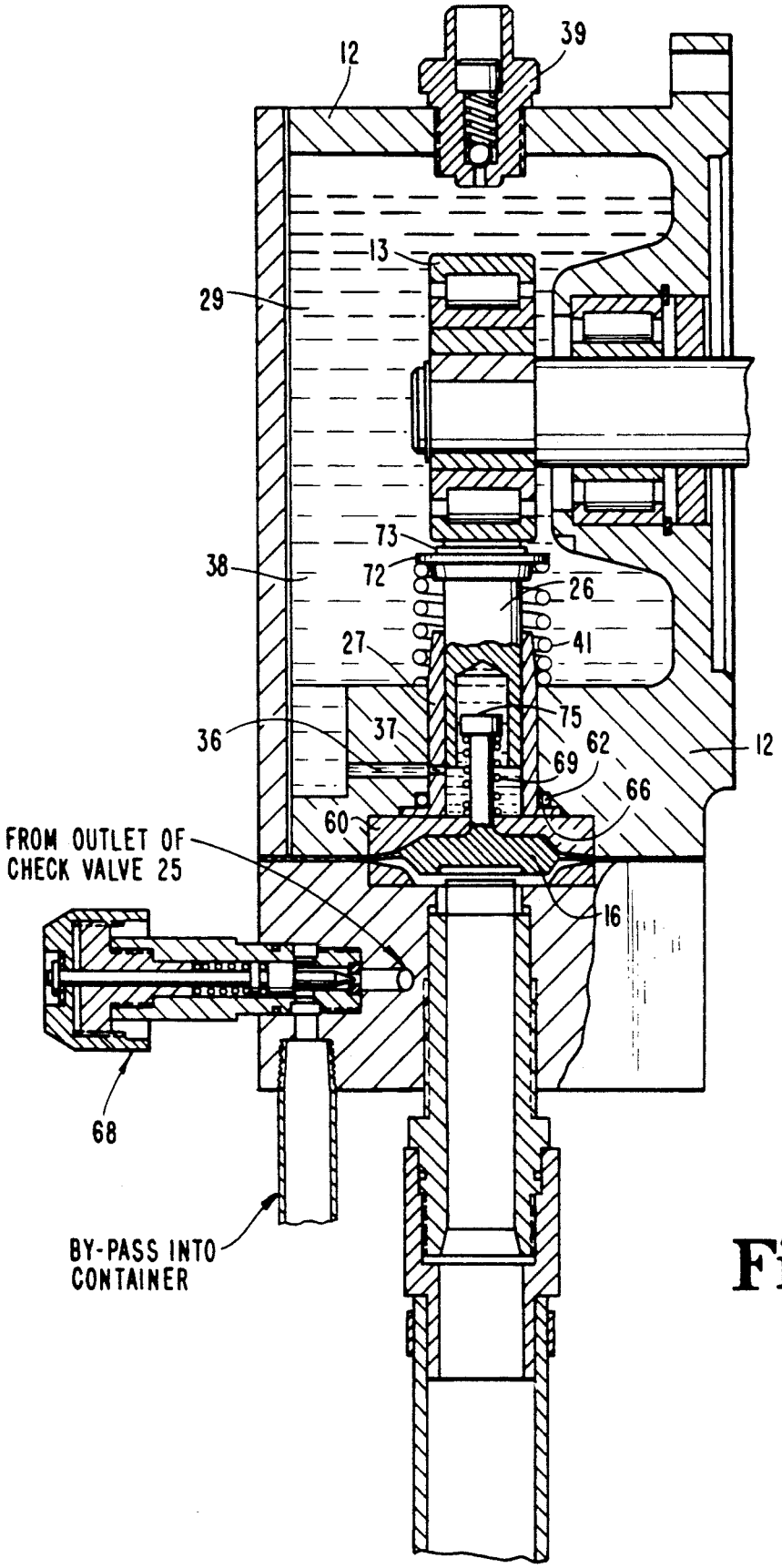
FIG. 2 is a diagrammatic side vertical cross-sectional view of the pump of FIG. 1.

Housing 12 defines sump 38 which contains driving fluid 29 and within which rotates eccentric bearing 13. Sump 38 is filled with driving fluid 29 and the top of housing 12 is vented to the atmosphere by means of a relief valve 39. Sump 38 communicates with the driving fluid pressure chamber 18 behind diaphragm 16 by means of a relief passage 31 and a refill passage 36 (FIG. 2). Refill passage 36 and a refill slot 37 in cylindrical chamber 27 are provided to replenish any driving fluid which is lost by leakage past piston 26 or cylindrical chamber 27. Slot 37 is uncovered by piston 26 only at the end of the suction stroke of the piston and is otherwise closed by piston 26. When slot 37 is uncovered, driving fluid 29 may flow freely into cylindrical chamber 27 from sump 38 through refill passage 36 and slot 37.

The flow of fluid through relief passage 31 is governed by adjustable pressure unloading valve 35. Adjustable valve 35 has a threadedly received control knob 32 which determines the spring force of spring 48 which urges the end face 50 of a valve member or "needle" 33 against seat 40 at the end of relief passage 31. A return opening 34 is provided for hydraulic fluid flowing from driving fluid chamber 18 through relief passage 31 and past needle 33.

The force with which needle 33 is seated is further governed by the pressure of the driven fluid in outlet passage 24. An unloading valve pressure chamber 42 is provided within valve body 43 and is in fluid communication with outlet passage 24 via stainless steel fluid line 47. Needle 33 extends within pressure chamber 42 and provides with seals 54 a larger radial pressure face at one end therein, thus creating major and minor pressure faces 45 and 46, respectively. Increases in pressure in outlet passage 24 act through fluid line 47, in pressure chamber 42 and upon major and minor faces 45 and 46 to urge needle 33 to the right against the bias of spring 48.

In sump 38, a spring 41 urges piston 26 against eccentric bearing 13. On the upstroke (pressure unloading) eccentric bearing 13 allows spring 41 to lift piston 26 upward. Diaphragm 16 flexes upward, due to return spring 69 creating a negative pressure in pump fluid chamber 17 with liquid being drawn in through line 21 and past check valve 22. On the following downstroke, eccentric bearing 13 drives piston 26 downward through a predetermined distance (pressure loading), which drives the fluid 29 in driving fluid chamber 18 ahead of piston forcing diaphragm 16 to flex downward which force check valve 22 closed and which drives the driven fluid in chamber 17 out through outlet check valve 25 and into outlet passage 24.

On the downstroke, hydraulic fluid flows through a groove 20 and into relief passage 31, the hydraulic fluid acting on end face 50 of needle 33, urging needle 33 to the right (as shown in FIG. 1), or to an open position, against the bias of spring 48. The area of major and minor pressure faces 45 and 46 and of end face 50 relative to the bias of spring 48 is such that needle 33 will open for large surges in driving fluid pressure within chamber 18 and across diaphragm to avoid damage to diaphragm 16. Such pressure surges will, as a result, create no more than the maximum desired pressure upon diaphragm 16 from the driving fluid side.

Heretofore, when the spray gun (not shown), connected to supply line 30, was throttled down or off with pump 11 still operating, piston pump 28 would continue to drive diaphragm 16 against the buildup of driven fluid within chamber 17 and outlet passage 24. This continual pounding greatly decreased the life of diaphragm 16 and check valve 22 as well as many other components. The conventional relief valve on such pumps will relieve this pressure once a threshold value is exceeded, but all components will remain subject to wear due to the continuous reduced opening and closing of the check valves and hydraulic pressure relief valve under high pressure.

In the present invention, when the flow in supply line 30 is throttled down or off by the spray gun (not shown) or by debris in the line, the buildup of pressure in outlet passage 24 acts upon needle 33, via fluid line 47, to urge needle 33 to the open position. At the first instant after flow in line 30 is blocked, the pressure in outlet passage 24 (and in valve pressure chamber 42) is not great enough, in addition with the average driving fluid pressure acting on end face 50, to unseat needle 33, pressure in outlet passage 24 is not relieved on the following upstroke of piston 26 due to outlet check valve 25. Each successive downstroke of piston 26 will increase the pressure in outlet passage 24, with no decrease therein, until that pressure, acting upon major and minor faces 45 and 46, unseats needle 33, providing a return path for driving fluid 29 through relief passage 31, past seat 40, through return opening 34 and back into sump 38, substantially decreasing the fluid force against diaphragm 16. When the throttle of the spray gun is opened and flow resumes through outlet passage 24, the pressure therein returns to the lower steady state value and needle 33 is closed by spring 48. The relationship of relief pressure threshold values between driving fluid chamber 18 and unloading valve pressure chamber 42 is determined by the relationship between end face 50 (the cross-sectional area exposed through seat 40) and major and minor faces 45 and 46, respectively (the difference in their cross-sectional areas). As seen in FIG. 1, the effective pressure face area (the difference in cross-sectional areas between major and minor faces 45 and 46) should be at least about twelve times larger than the sealing end face area (the cross-sectional area of end face 50 which is exposed through seat 40). It is desirable, for example, that for small pumps having a flow rate of about 0.5 gallons per minute, the effective pressure face area should be about thirteen to fourteen times larger than the sealing end face area. For larger pumps having flow rates of about two gallons per minute, the effective pressure surface area should be about twenty times larger than the sealing end face area. Fine tuning is provided by control knob 32 which decreases or increases the bias of spring 48 against needle 33. An outer limit to which control knob 32 may be backed out is provided by retaining ring 70.

Fluid line 47 is connected to adjustable pressure unloading valve 35 by swivel 51 which allows for thread orientation of valve body 43 relative to pump casing 12. Swivel 51 is held onto valve body 43 by retaining member 52. Fluid line 47 is in communication with valve pressure chamber 42 via hole 44 and annular recess 53 of swivel 51 and via hole 76 of valve body 43. Seals 49 are provided to retain fluid within annular recess 53. To facilitate cleaning and to promote better sealing within valve pressure chamber 42, grease is used within chamber 42 and fluid line 47 to transmit the hydraulic pressure changes from outlet chamber 24 to needle 33. A diaphragm 55 with a central restrictor hole 65 is used where fluid line 47 meets outlet passage 24 to separate the grease in fluid line 47 from the driven fluid (paint or other fluid) in outlet passage 24.

Vent holes 57 are provided on both sides of valve pressure chamber 42 to allow movement of the sealed valve member or needle 33 within valve body 43 and to provide an indication of seal failure of either seals 54 (for valve pressure chamber 42) or seal 59 (for return path of driving fluid).

Driving fluid chamber 18 is defined by diaphragm 16, piston 26, cylindrical chamber 27 and upper retaining member 60. Although fluid 29 is only intended to pass to or from chamber 18 through groove 20 and refill passage 36, hydraulic fluid blow-by often occurs in prior art devices whereby fluid 29 seeps between cylindrical chamber 27 and member 60, or between diaphragm 16 and member 60, up along the outside of cylindrical chamber 27 and back into sump 38. To retard this seepage, an anti-blow-by seal 62 is provided.

The bottom of cylindrical chamber 27 extends radially outwardly forming an annular disc 63 which abuts snugly against the top of member 60. Disc 63 forms a shoulder with side walls 64 of cylindrical chamber 27 which, along with corresponding annular recess 66 of pump casing 12, snugly receives anti-blow-by seal 62. The components of pump 11 keep anti-blow-by seal 62 tightly compressed between the shoulder of cylindrical chamber 27 and recess 66, effectively sealing off fluid blow-by. In the event that some loosening of components does occur, the anti-blow-by seal configuration of the present invention will still prevent blow-by. As fluid attempts to seep between member 60 and the bottom of cylindrical chamber 27 during a positive pressure stroke (pressure loading), the hydraulic fluid force pushes cylindrical chamber 27 upward, thus compressing and tightening anti-blow-by seal 62 within recess 66.

The above-described preferred embodiment of the unloading valve is partially responsive to changes in driving fluid pressure. Other embodiments are contemplated wherein the unloading valve is responsive to the outlet passage pressure and not to the driving fluid pressure.

While the invention has been illustrated and described in detail in the drawings and foregoing description, the same is to be considered as illustrative and not restrictive in character. Accordingly, the scope of the present invention is only to be limited as necessitated by the accompanying claims and equivalents thereof.

What is claimed is:

1. In a diaphragm pump having a driving fluid chamber and a pump chamber, a diaphragm separating the chambers, inlet and outlet passages to the pump chamber, a check valve between the pump chamber and the outlet passage, and drive means for alternately pressure loading and unloading fluid in the driving fluid chamber, the improvement which comprises:

valve means responsive to fluid pressure in the outlet passage and for relieving driving fluid chamber pressure when the outlet passage fluid pressure exceeds a predetermined value and wherein the valve means includes a valve chamber in communication with the outlet passage, a seat defining a pressure relief orifice in communication with the driving fluid chamber, a valve member slidably responsive within the valve chamber to changes in outlet passage fluid pressure, the valve member having a sealing surface, and a spring urging the sealing surface against and in sealing relation with the seat; and, wherein said diaphragm pump further includes a pump casing and wherein the driving fluid chamber is defined by an upper diaphragm retaining member secured adjacent said casing and a cylindrical pressure chamber having cylindrical walls and a lower outwardly extending disc portion axially sandwiched between said member and the pump casing, the diaphragm pump further including an anti-blow-by seal sandwiched between the pump casing and the cylindrical pressure chamber adjacent the cylindrical walls and the disc portion.

2. An adjustable pressure unloader valve for use in a diaphragm pump which includes a driving fluid chamber and a pump chamber for pumping driven fluid, a diaphragm separating the chambers, inlet and outlet passages to the pump chamber, a check valve between the pump chamber and the outlet passage, and drive means for alternately pressure loading and unloading driving fluid in the driving fluid chamber, the unloader valve comprising:

a valve body connected to the pump and defining a valve chamber having fluid therein;

a seat defining a pressure relief orifice in communication with the driving fluid chamber;

a valve member having a sealing face at one end and having a pressure face located within said valve chamber;

a spring biasing the sealing surface against and in sealing relation with the seat;

adjusting means for adjusting the force exerted by said spring to bias the sealing surface, said adjusting means extending axially away from said valve member, from an end opposite the sealing face; and, wherein said valve member has a steady state position where said sealing face is disposed in sealing relation with said seat and wherein said valve member has a first relief position where the fluid pressure in the outlet passage, while exceeding a first predetermined threshold value, acts upon the fluid in the valve chamber which acts upon the pressure face and urges said valve member against the bias of said spring and where said sealing face is unseated from said seat.

3. In a diaphragm pump having a driving fluid chamber and a pump chamber, a diaphragm separating the chambers, inlet and outlet passages to the pump chamber, a check valve between the pump chamber and the outlet passage, and drive means for alternately pressure loading and unloading driving fluid in the driving fluid chamber, the improvement which comprises:

a seat defining a pressure relief orifice in communication with the driving fluid chamber;

a needle valve member having a sealing surface;

a spring urging the sealing surface against and in sealing relation with the seat;

wherein the needle valve member is responsive to fluid pressure in the outlet passage and relieves driving fluid chamber pressure when the outlet passage fluid pressure exceeds a predetermined value; and, wherein said sealing surface faces axially away from the needle valve member.

4. An adjustable pressure unloader valve for use in a diaphragm pump which includes a driving fluid chamber and a pump chamber for pumping driven fluid, a diaphragm separating the chambers, inlet and outlet passages to the pump chamber, a check valve between the pump chamber and the outlet passage, and drive means for alternately pressure loading and unloading driving fluid in the driving fluid chamber, the unloader valve comprising:

a valve body connected to the pump and defining a valve chamber having fluid therein;

a seat defining a pressure relief orifice in communication with the driving fluid chamber;

a valve member having a sealing face at one end and having a pressure face located within said valve chamber wherein said sealing face faces axially away from said pressure face;

a spring biasing the sealing surface against and in sealing relation with the seat; and, wherein said valve member has a steady state position where said sealing face is disposed in sealing relation with said seat and wherein said valve member has a first relief position where the fluid pressure in the outlet passage, while exceeding a first predetermined threshold value, acts upon the fluid in the valve chamber which acts upon the pressure face and urges said valve member against the bias of said spring and where said sealing face is unseated from said seat.

5. In a diaphragm pump having a driving fluid chamber and a pump chamber, a diaphragm separating the chambers, inlet and outlet passages to the pump chamber, a check valve between the pump chamber and the outlet passage, and drive means for alternately pressure loading and unloading driving fluid in the driving fluid chamber, the improvement which comprises:

valve means responsive to fluid pressure in the outlet passage, said valve means being for relieving driving fluid chamber pressure when the outlet passage fluid pressure exceeds a predetermined valve, said valve means being at least about twelve times more responsive to outlet passage fluid pressure than to driving fluid chamber pressure.

6. The diaphragm pump of claim 5 wherein the valve means includes:

a valve chamber in communication with the outlet passage;

a seat defining a pressure relief orifice in communication with the driving fluid chamber;

a valve member slidably responsive within the valve chamber to changes in outlet passage fluid pressure, the valve member having a sealing surface; and, a spring urging the sealing surface against and in sealing relation with the seat.

7. The diaphragm pump of claim 5 further including:

a seat defining a pressure relief orifice in communication with the driving fluid chamber;

a valve member having a sealing surface;

a spring urging the sealing surface against and in sealing relation with the seat; and, wherein the valve member is slidably responsive away from said seat to increases in the outlet passage fluid pressure.

8. In a diaphragm pump having a driving fluid chamber and a pump chamber, a diaphragm separating the chambers, inlet and outlet passages to the pump chamber, a check valve between the pump chamber and the outlet passage, and drive means for alternately pressure loading and unloading driving fluid in the driving fluid chamber, the improvement which comprises:

valve means for relieving driving fluid chamber pressure when the outlet passage fluid pressure exceeds a predetermined value, said value means including a valve member defining a sealing end face in communication with the driving fluid chamber and defining an effective pressure face in communication with the outlet passage, wherein said effective pressure face has a cross-sectional area of said sealing end face, and wherein said valve member is slidably responsive within the valve chamber to changes in outlet passage fluid pressure.

9. The diaphragm pump of claim 8 wherein the cross-sectional area of the effective pressure face is between about thirteen and about fourteen times greater than the cross-sectional area of the sealing end face for pumps having a flow rate of about one-half gallon per minute.

10. The diaphragm pump of claim 8 wherein the cross-sectional area of the effective pressure face is about twenty times greater than the cross-sectional area of the sealing end face for pumps having a flow rate of about two gallons per minute.

11. In a diaphragm pump having a driving fluid chamber and a pump chamber, a diaphragm separating the chambers, inlet and outlet passages to the pump chamber, a check valve between the pump chamber and the outlet passage, and drive means for alternately pressure loading and unloading driving fluid in the driving fluid chamber, the improvement which comprises:

valve means responsive to fluid pressure in the outlet passage and for relieving driving fluid chamber pressure when the outlet passage fluid pressure exceeds a predetermined value, said valve means including a seat defining a pressure relief orifice in communication with the driving fluid chamber, a valve member having a sealing surface, a spring urging the sealing surface against and in sealing relation with the seat, and a valve chamber in hydraulic communication with the outlet passage and wherein said valve member extends through said valve chamber and is slidably responsive away from said seat to outlet passage fluid pressures above a predetermined threshold value.

12. The diaphragm pump of claim 11 wherein said valve means further includes a fluid line connected between and providing communication between the outlet passage and said valve chamber and wherein said valve chamber and said fluid line are filled with a dense liquid.

13. The diaphragm pump of claim 12 wherein the dense liquid is grease.

14. The diaphragm pump of claim 12 wherein said valve means further includes:

a valve body and seals surrounding said valve member and sealing said valve chamber, and seal failure hole means for indicating failure of the seals.

15. The diaphragm pump of claim 12 further including a diaphragm with a restrictor hole, the diaphragm located within said fluid line or said outlet passage to provide separation between the dense liquid within the fluid line and the outlet fluid within the outlet passage.

16. An adjustable pressure unloader valve for use in a diaphragm pump which includes a driving fluid chamber and a pump chamber for pumping driven fluid, a diaphragm separating the chambers, inlet and outlet passages to the pump chamber, a check valve between the pump chamber and the outlet passage, and drive means for alternately pressure loading and unloading driving fluid in the driving fluid chamber, the unloader valve comprising:

a valve body connected to the pump and defining a valve chamber having fluid therein;

a seat defining a pressure relief orifice in communication with the driving fluid chamber;

a valve member having a sealing face at one end and having a pressure face located within said valve chamber;

a spring biasing the sealing surface against and in sealing relation with the seat;

wherein said valve member has a steady state position where said sealing face is disposed in sealing relation with said seat and wherein said valve member has a first relief position where the fluid pressure in the outlet passage, while exceeding a first predetermined threshold value, acts upon the fluid in the valve chamber which acts upon the pressure face and urges said valve member against the bias of said spring and where said sealing face is unseated from said seat; and, wherein said valve body includes seals surrounding said valve member and wherein said valve body, in combination with said valve member and said seals, define major and minor pressure faces.

17. The adjustable pressure unloader valve of claim 16 wherein said valve body includes seal failure indicator means for indicating failure of the seals.

18. The adjustable pressure unloader valve of claim 17 further including a fluid line between said valve chamber and the outlet passage and providing fluid communication therebetween and wherein said valve chamber and said fluid line are filled with a thick hydraulic fluid.

19. The adjustable pressure unloader valve of claim 18 wherein the thick hydraulic fluid is grease.

20. The adjustable pressure unloader valve of claim 18 wherein the outlet passage is a conduit for the driven fluid and further including a diaphragm with restrictor hole disposed between the thick hydraulic fluid and the driven fluid.

21. An adjustable pressure unloader valve for use in a diaphragm pump which includes a driving fluid chamber and a pump chamber for pumping driven fluid, a diaphragm separating the chambers, inlet and outlet passages to the pump chamber, a check valve between the pump chamber and the outlet passage, and drive means for alternately pressure loading and unloading driving fluid in the driving fluid chamber, the unloader valve comprising:

a valve body connected to the pump and defining a valve chamber having fluid therein;

a seat defining a pressure relief orifice in communication with the driving fluid chamber;

a valve member having a sealing face at one end and having a pressure face located within said valve chamber;

a spring biasing the sealing surfaces against and in sealing relation with the seat;

wherein said valve member has a steady state position where said sealing face is disposed in sealing relation with said seat and wherein said valve member has a first relief position where the fluid pressure in the outlet passage, while exceeding a first predetermined threshold value, acts upon the fluid in the valve chamber which acts upon the pressure face and urges said valve member against the bias of said spring and where said sealing face is unseated from said seat; and, wherein the unloader valve further includes a pump casing and wherein the driving fluid chamber is defined by an upper diaphragm retaining member secured adjacent said casing and a cylindrical pressure chamber having cylindrical walls and a lower outwardly extending disc portion axially sandwiched between said member and the pump casing, the diaphragm pump further including an anti-blow-by seal sandwiched between the pump casing and the cylindrical pressure chamber adjacent the cylindrical walls and the disc portion.

22. A diaphragm pump having a sump, a driving fluid chamber, a pump chamber and a diaphragm separating the chambers, comprising:

a pump casing having a central bore in communication at its top with the sump;

an upper diaphragm retaining member secured adjacent said casing below and aligned with the bore;

a cylindrical pressure chamber received within the bore, having cylindrical walls and having a lower outwardly extending disc portion axially sandwiched between said member and said pump casing, the disc portion having a top;

wherein said casing includes an annular recess in communication with the bore and which, along with the outside of the cylindrical walls and the top of the disc portion, defines an annular seal receiving region; and, an anti-blow-by seal sandwiched between said pressure chamber and said casing within the annular seal receiving region.

23. The diaphragm pump of claim 22 wherein said retaining member is physically distinct from said pressure chamber.

* * * * *